US006082062A

United States Patent [19]

Alflen

[11] Patent Number: 6,082,062

[45] Date of Patent: Jul. 4, 2000

[54] SECURITY ATTACHMENT SYSTEM

[76] Inventor: Michael J. Alflen, 1705 Central Ave., Merritt Island, Fla. 32952

[21] Appl. No.: 09/141,568

[22] Filed: Aug. 27, 1998

Related U.S. Application Data

[60] Provisional application No. 60/057,737, Aug. 28, 1997.

[51] Int. Cl.[7] ..... E06B 1/62

[52] U.S. Cl. ..... 52/202; 52/171.3; 52/203; 52/204.53

[58] Field of Search ..... 52/202, 203, 204.53, 52/204.54, 204.5, 171.3

[56] References Cited

U.S. PATENT DOCUMENTS

| | | | |
|---|---|---|---|
| 3,203,053 | 8/1965 | Lane et al. | 52/204.54 |
| 4,121,394 | 10/1978 | Brooks | 52/203 |
| 4,189,880 | 2/1980 | Ballin | 52/202 |
| 4,210,191 | 7/1980 | Li | 160/354 |
| 4,319,623 | 3/1982 | Krogseng | 160/90 |
| 4,423,575 | 1/1984 | Lagergren et al. | 52/204.53 |
| 4,441,290 | 4/1984 | Abell | 52/202 |
| 4,453,585 | 6/1984 | Ruggeberg | 160/354 |
| 4,473,980 | 10/1984 | Foster | 52/202 |
| 4,514,465 | 4/1985 | Schoenberg | 428/339 |
| 4,590,124 | 5/1986 | Schoenberg | 428/339 |
| 4,665,670 | 5/1987 | Van Den Burg | 52/202 X |
| 5,097,642 | 3/1992 | Richardson et al. | 52/171.3 |
| 5,173,800 | 12/1992 | King | 52/171.3 X |
| 5,222,343 | 6/1993 | Anderson | 52/718.04 |
| 5,230,954 | 7/1993 | Sakamoto | 428/332 |
| 5,426,897 | 6/1995 | Gazaway | 52/204.53 |
| 5,636,484 | 6/1997 | Deblock | 52/204.5 |
| 5,758,459 | 6/1998 | Koike et al. | 52/204.5 X |

FOREIGN PATENT DOCUMENTS

| | | | |
|---|---|---|---|
| 751697 | 1/1967 | Canada | 52/204.53 |
| 2400607 | 4/1979 | France | 52/202 |

*Primary Examiner*—Carl D. Friedman
*Assistant Examiner*—Phi Dieu Tran A
*Attorney, Agent, or Firm*—Brian S. Steinberger; Law Offices of Brian S. Steinberger

[57] ABSTRACT

A security attachment system for windows having laminated film covering the glass panes. The system includes positioning two-sided tape that overlaps both an edge portion of the film and a side portion of the adjacent window frame. A hollow flange track having a right-angled cross-sectional shape is positioned over the tape. The flange track has a stepped up bottom which fits about the raised pre-existing spline between the glass and the side frame. Screw type fasteners are inserted into the flange to it to the sides of the window frame. A snap on cover plate with bulbous shaped prongs fits over a longitudinal opening in the flange track. Flange tracks and their respective cover plates are provided for each of the four edges where the window frames meet the glass panes. The security system increases the tensile strength of the glass and film cover and is useful against projectiles and during hurricane storm conditions. A second version uses a cover plate with bent prongs and a bent edge to be attached to the opening side of the track.

20 Claims, 5 Drawing Sheets

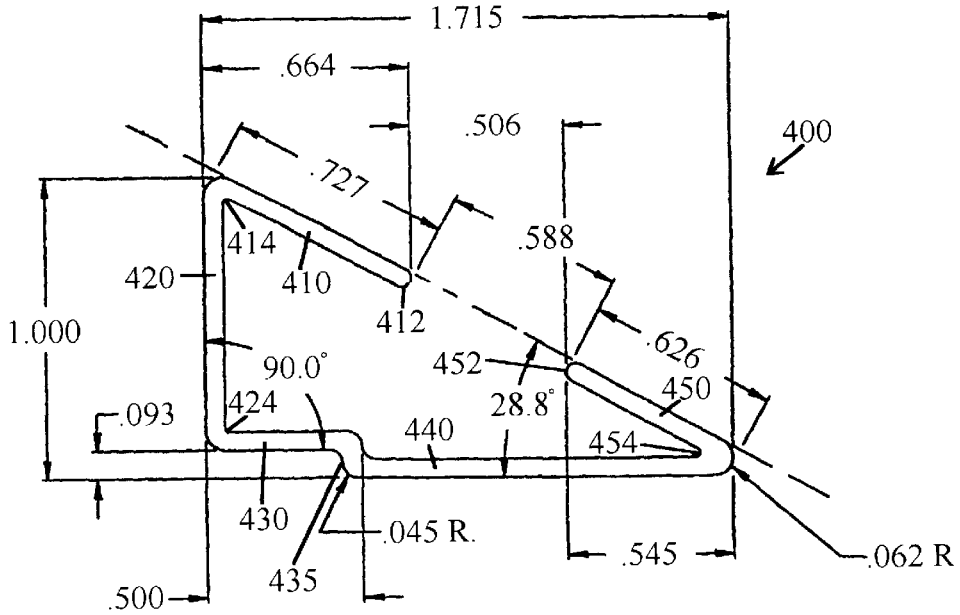
Fig. 6
Fig. 7A
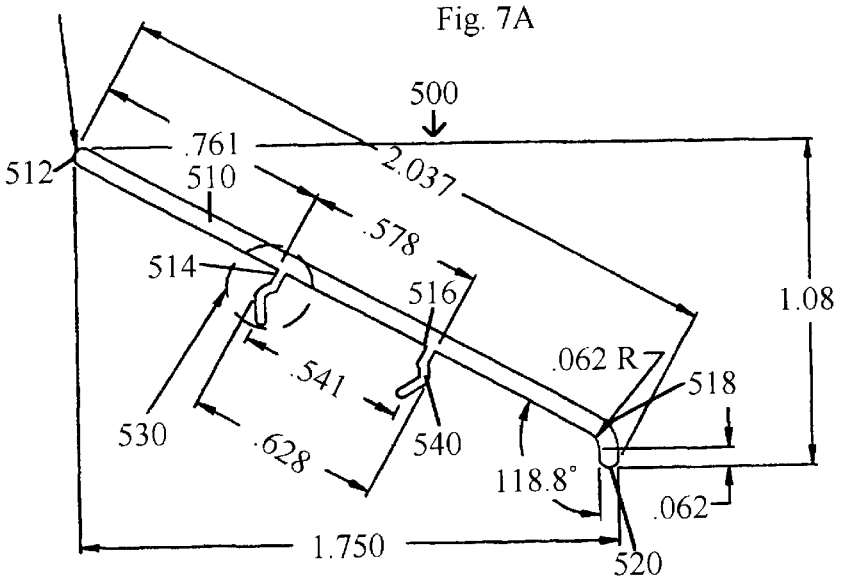
Fig. 7B
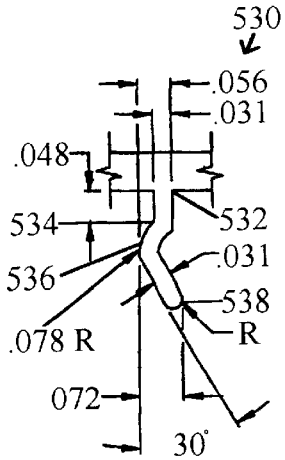

SECURITY ATTACHMENT SYSTEM

This invention relates to window security systems, and in particular to a method and flange track apparatus for increasing the strength of film covered windows. This application is a Continuation-In-Part of Provisional Application Ser. No. 60/057,737 filed on Aug. 28, 1997.

BACKGROUND AND PRIOR ART

Damage from storms such as a hurricane can occur from flying debris and water crashing through windows and causing damage inside of the structures. Further, homeowners abandoning their homes before a storm also leave a security risk since vandals and thieves can break into the homes. The problem of protecting homes in areas such as Florida further exacerbates the problems of protecting windows since multiple storms such as hurricanes can occur over the lifetime of residential and commercial structures. Storm damage from hurricane Andrew caused billions of dollars in property damage.

Homeowners abandoning their homes before a storm also leave a security risk since vandals and thieves can break into the homes. Also merely leaving ones home for a vacation poses a security risk as well. Also merely leaving a home for a vacation poses a security risk as well whereas break-ins can occur by merely smashing existing window panes with projectiles such as bricks and the like.

In the past several years there has also been an increase in explosions either accidental or intended for commercial office buildings and government buildings including embassies. The shattered glass from an explosion has been known to be extremely dangerous and harmful to property as well as occupants and visitors.

The protecting of windows and doors has generally been accomplished in the past by using shutters. Various outside shutter shields can be expensive and time consuming to apply due to hardware required by the shield or shutter. An additional problem is that these window shields can be difficult and time consuming to apply before a coming storm. The basic shutters are difficult to connect with each other when protecting large windows and door openings. Further, shutters generally require having components and hardware stay in place adjacent to the window and door opening which results in unsightly appearances. Popular shutter shields such as the roll-down variety are also expensive. Typical costs for a lowerable shield and motor can be $450 to over a $1,000 for a typical average window of 37 by 50 inches. An additional problem with these outdoor shields is that many of these shields must be left in place in order to be used and can create an unsightly appearance. For example, rolling shields may have large rollers left in position above windows when not in use.

Other types of shutter closures have included nailing plywood type boards across the openings. However, individual pieces of plywood are usually only capable of being used once and the nailing operation can cause damage to the surrounding structure from applying and removing the nails. An additional problem is that these outdoor shutters can be difficult and time consuming to apply before a coming storm. For example it would be impossible for homeowners of high rise condominiums to go outside in order to put up these shutters.

Additional methods of protecting windows has included applying tape to glass areas to prevent flying glass from breakage. However, again this technique has generally required a homeowner or business owner tape unsightly tape such as duct tape on the windows before the storm occurs. Besides the unsightly appearance, the tape itself is difficult to remove and at most the tape strips only allow the window glass to break into large pieces.

Window film has been applied to window panes for tinting purposes and has also helped to hold breaking glass pieces together and further allows the glass to break into large pieces. Examples of well known window film material include U.S. Pat. Nos. 4,514,465 and 4,590,124 to Schoenberg and 5,230,954 to Sakamoto. However, the window tint taping by itself does not prevent the breakage of the glass, nor does the taping fully prevent the glass from separating from the edges of the windows and falling inward.

Various techniques have been proposed to strengthen the fastening of the window tint film to window frames. See U.S. Pat. Nos. 4,189,880 to Ballin; 4,210,191 to Li; 4,319,623 to Krogseng et al. and 5,426,897 to Gazaway. However, again these prior art approaches still do not adequately prevent projectiles from separating the window panes from the frame themselves.

SUMMARY OF THE INVENTION

The first object of the present invention is to provide a system for increasing the tensile strength of window covering film by attaching the film edges to a window frame.

The second object is to provide a system for holding and preventing window pane covering film from separating from the window frame during extreme storms such as hurricanes and from explosive blasts.

The third object is to provide a system for holding and preventing window pane covering film from separating from the window frame when the window panes are being subjected to projectiles.

The fourth object is to provide a security system that seals window film edges against existing windows and prevents water from entering through that window.

The fifth object is to incorporate window security and storm/explosion protection that is aesthetically pleasing to the eye.

The sixth object is to provide security protection for window panes having film that is easy to apply.

The seventh object is to provide security protection for window panes having film that is less expensive than conventional window shield such as shutters.

The eighth object is to provide security protection for window panes having film useful in government, commercial and residential structures including high-rise buildings.

The invention encompasses a method and apparatus for applying a security attachment to a window having a film cover. The first step is to apply two-sided tape to overlap both a portion of a window pane film edge and over an edge portion of an adjacent window frame. Next a flange is positioned over the tape. The flange has a hollow track having a substantially right triangular cross-section with a base portion for abuting against the portion of the window frame, a straight back portion perpendicular to the base for abutting against the portion of the window pane, and an angled side. The next step has the flange being attached to the portion of the window frame with fasteners such as screws and bolts. The track has a step-out portion wall which abuts against a spline of the window pane. The film, the flange, the fasteners and the tape together form a security attachment for the window pane. A cap cover having a T-shaped cross-section with a base portion having at least on bulb shaped tip snaps into a longitudinal opening within the angled side of the hollow track. Flanges and their respective cap covers are positioned over each of the four sections areas around the window frame and window film. A second version uses a cap cover having one bent end and bent prongs underneath the cover for snapping into the opening of the track.

Further objects and advantages of this invention will be apparent from the following detailed description of a presently preferred embodiment which is illustrated schematically in the accompanying drawings.

BRIEF DESCRIPTION OF THE FIGURES

FIG. 1A is a front perspective view of a window that can be used in the subject invention.

FIG. 6 is a cross-sectional side view of another version of the main track used in the novel security system.

FIG. 7A is a cross-sectional view of another version of the top cap cover used with the novel security system.

FIG. 7B is an enlarged view of one of the prongs of the top cap cover of FIG. 7A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1B:
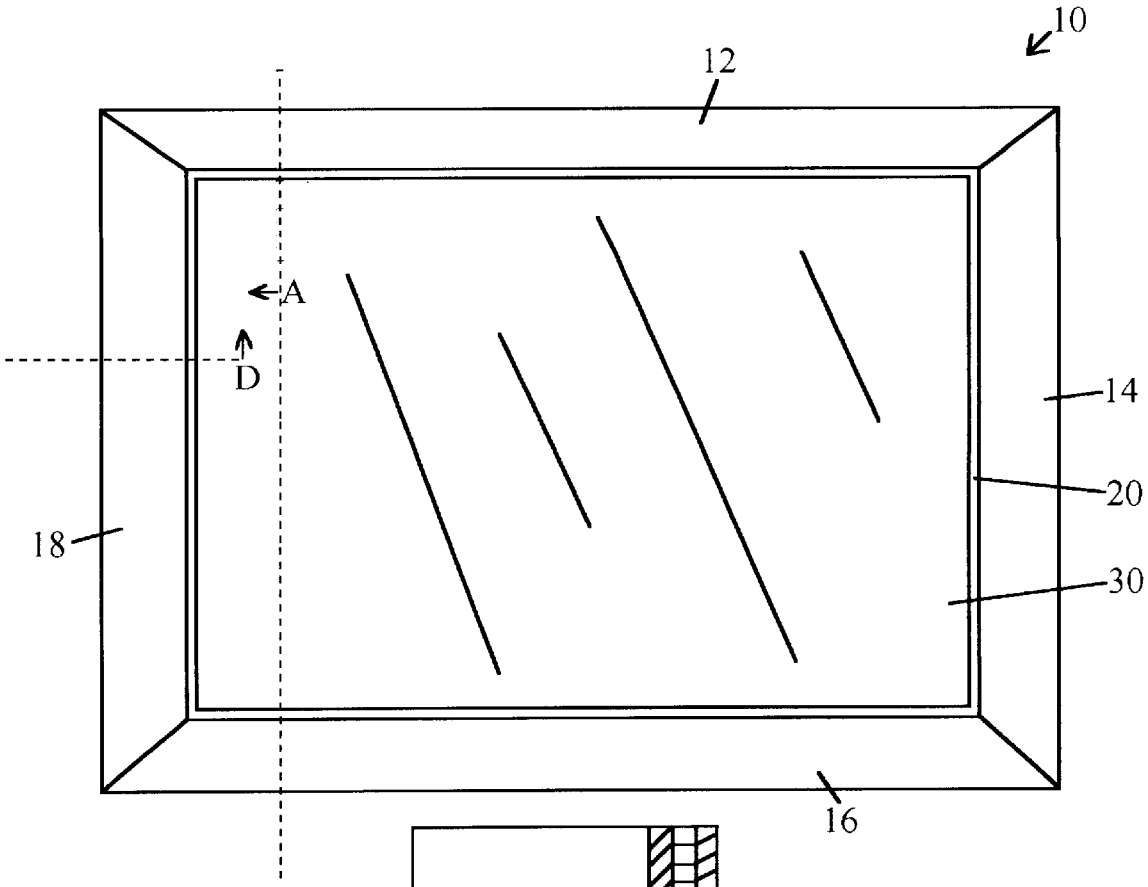
FIG. 1B is a cross-sectional side view of a window frame of FIG. 1A along arrow A.
Figure 1B:
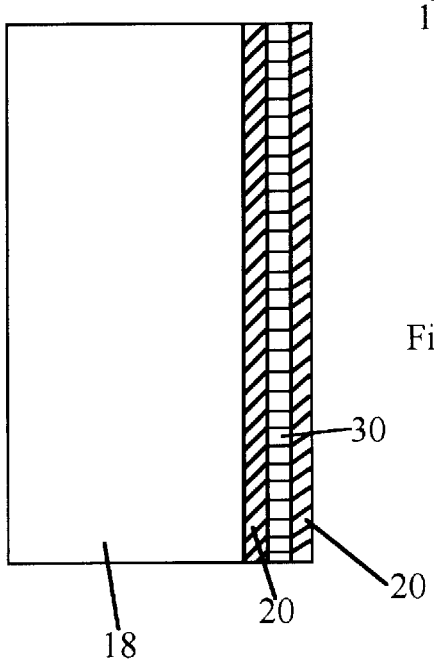

FIG. 1A is a front perspective view of a window 10 that can be used in the subject invention. FIG. 1B is a side view of a window frame 18 of FIG. 1A along arrow A. Referring to FIGS. 1A–1B, a traditional box type window 10 includes a rectangular box frame 10, 12, 14, 16, 18 with a raised resilient spline 20 separating the inner perimeter of the frame members 10–18 from a glass pane 30. The box frame members 10-18 are perpendicular to the glass pane 30.

Figures 2, 3:
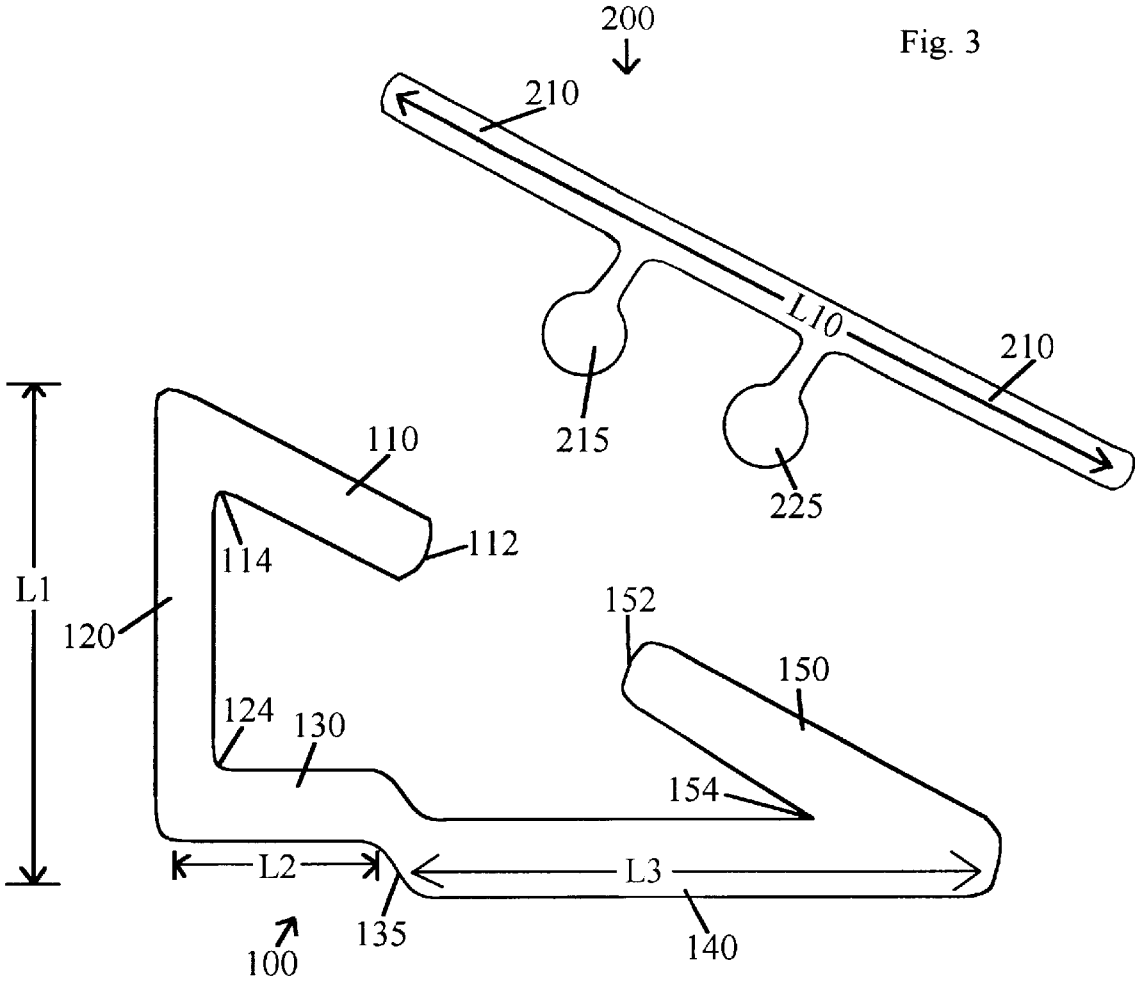
FIG. 2 is a cross-sectional side view of the main base track used in the novel security system.
FIG. 3 is a cross-sectional side view of the top cap cover used with the main base track of FIG. 1.

FIG. 2 is a cross-sectional side view of the main base track 100 used in the novel security system of the subject invention. Longitudinal base track 100 has a right triangular cross-sectional shape as shown in FIG. 2 and can be formed from PVC, pre-injection molded plastic and the like. Track 100 includes left side 120 which is approximately 1 inch (L1) in height, and is perpendicular at point 124 to first base portion 130, the latter of which has a length L2 of approximately ½ inch, which is raised approximately ⅛ of an inch at 135 above second base portion 140, the latter having a length, L3 of approximately 1& ¼ inch. Left corer 114 and right corer 154 are approximately 45 degree angled connections having first top rim 110 and second top rim 150 which are separated by an approximately ½ inch space formed between ends 112 and 152.

FIG. 3 is a cross-section side view of the top cap cover 200 used with the main base track 100 of FIGS. 1A–1B. Referring to FIG. 3, cap cover 200 includes a longitudinal flat planar top plate 210 having a length L10 of approximately 1& ¾ inches, thickness of approximately ⅛ of an inch and a channel formed from two bulbous shape projections 215, 225 extending perpendicular beneath top plate 210. The ends of the plate 210 and the outer comers of main track 100 of FIG. 2 can have rounded edges.

Figures 4, 5:
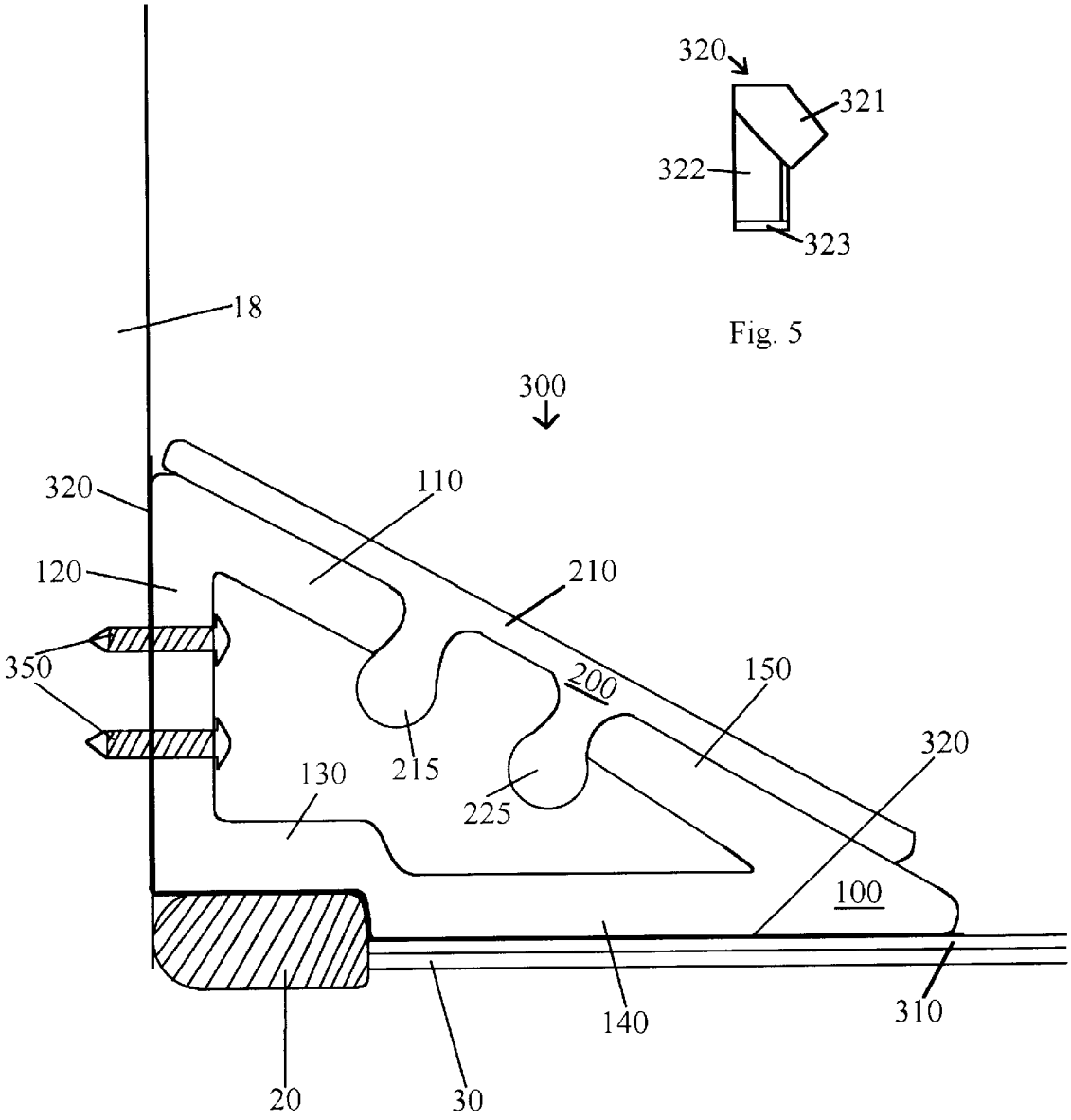
FIG. 4 is a cross sectional view of the main base track and top cap cover of FIGS. 2 and 3 along arrow D of FIG. 1.
FIG. 5 is a perspective view of two-sided tape that can be used with the subject invention.

FIG. 4 is a cross sectional view 300 of the main base track 100 and top cap cover 200 of FIGS. 2 and 3 along arrow D of FIG. 1A. The steps of assembling the subject invention will now be described in reference to FIGS. 1A and 4. First a window 10 of FIG. 1A has a laminated film 310 applied to the interior surface of glass pane 30. The invention can be used on windows having various types of resilient polyester type laminated films such as but not limited to the MAX PRO laminated films of approximately 50 microns(2 mils) up to approximately 335 microns(14 mils) thick, manufactured by ClearDefense®Window Film Technology of Martinsville, Va. Other laminated window films can be used such as the ones described in the background section above.

Referring to FIGS. 1A, 4 and 5, the second step of assembly is to remove one backing side 321 of a length of two sided plastic tape 320, and apply the exposed side to both frame side 18 about spline 20 and overlapping a portion of the film 310 as shown in FIG. 4. Next the opposite tape backing 323 is removed. The two sided tape useful in the subject invention can be approximately 2 to approximately 4 mils thick. A preferred two-side tape is the 1 & ½ inch wide Model: Big Red BTOOO manufactured by Brom of Denver, Colo. Next left side of track 120 and bottom portions 130, 140 are placed over the remaining exposed side of the tape 320. Fasteners 350 such as but not limited to 1 inch long and ⅛ inch diameter screws are drilled through the inner side of left side 120 and screwed into frame 18. Fasteners 350 can be metal screws, wood screws, bolts and the like. After the main track 100 is attached, the bulbous channels 215, 225 of top cap cover 200 are snapped in place over the main track 100. Sections of main track 100 and top cover 200 are separately attached for each of the four sides of the window 10 depicted in FIG. 1A.

FIG. 6 is a cross-sectional side view of another version of the main track used in the novel security system. Referring to FIG. 6, longitudinal base track 400 has a right triangular cross-sectional shape and can be formed from PVC, pre-injection molded plastic and the like. Track 400 includes left side 420 which is approximately 1 inch in height, and is perpendicular at point 424 to first base portion 430, the latter of which has a length approximately 0.5 inch, which is raised approximately 0.093 inches at 435 above second base portion 440, the latter having a length of approximately 1.215 inches. Left upper corer 514 has an angle of approximately 45 degrees while right corer 554 has an angle of approximately 28.8 degrees. Left top rim 410 has a length of approximately 0.727 inches, and right top rim 450 has a length of approximately 0.626 inches, with a spacing between rim edges 412 and 452 being approximately 0.588 inches.

FIG. 7A is a cross-sectional view of another version of the top cap cover 500 used with the track 400 of FIG. 6. Referring to FIG. 7A, cap cover 500 includes a longitudinal flat planar top plate 510 having a length rounded end 512 to bent end tip 520 of approximately 2.037 inches, and a channel formed from two bent prongs 530, 540 extending perpendicular beneath top plate 510. First bent prong 530 is positioned beneath cover 5100 at point 514 approximately 0.761 inches from end 512. Second prong 450 is located at point 516 approximately 0.541 inches from first prong 530. End 520 bends down at an angle of approximately 8 degrees at point 518 of cover 510

Figure 8:
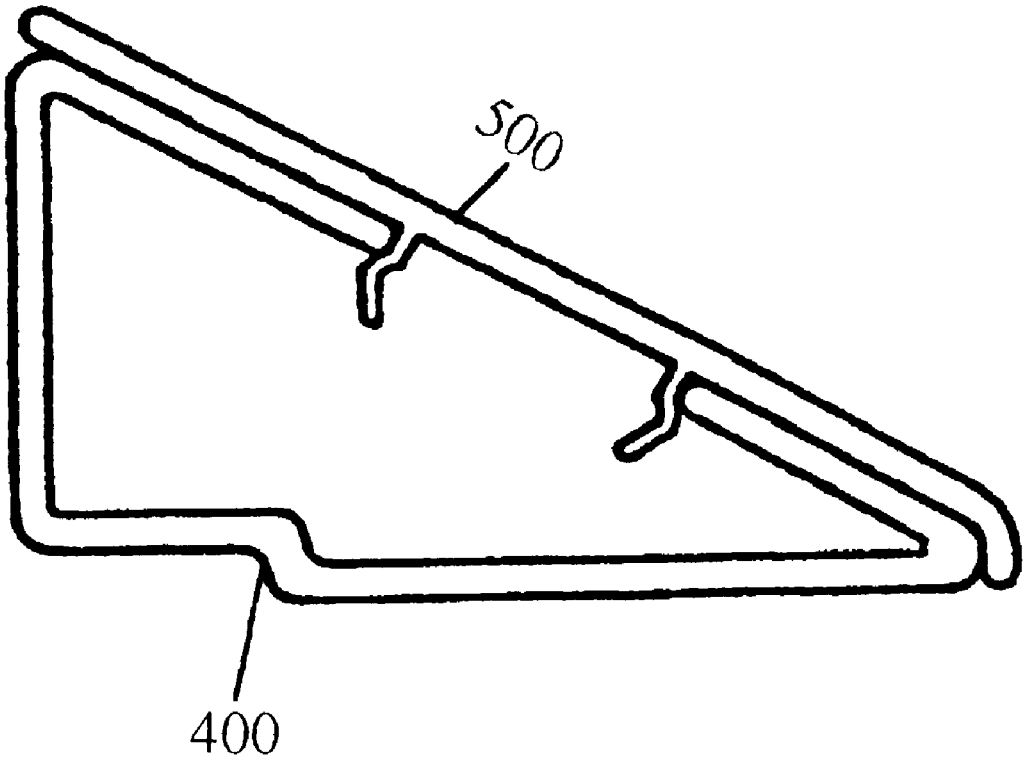
FIG. 8 is a view of the top cap cover and track of FIGS. 6, 7A–7B attached together.

FIG. 7B is an enlarged view of one of the prongs 530 of the top cap cover of FIG. 7A. Prong 530 has a thickness of approximately 0.031 inches. Prong 530 includes a first upper portion between points 532 and 534 which is perpendicular to the bottom of plate 510, an upper left angled bend at 536 has a radius of approximately 0.078 inches, and a bottom right angled bend between points 536 and 538 is approximately 30 degrees from the vertical. Right prong has the same dimensions in an opposite direction(namely an upper right angled bend and a bottom left angled bend, respectively). The respective upper angled bends of the prongs 530 and 540 are spaced to snap within the rim ends 412 and 452 of the track 400 shown in FIG. 6. FIG. 8 is a view of the top cap cover 500 and track 400 of FIGS. 6, 7A–7B attached together.

The invention can be used on windows having metal, wood, plastic and concrete frames.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of applying a security attachment to windows having protective film covers, comprising the steps of:

(a) applying a protective film to cover one side face of a window pane substantially up to where edges on the one side face of the window pane are attached to a window frame;

(b) applying tape to overlap both a portion of the edges of the window pane film and a portion of the window frame;

(c) positioning a flange over the tape; and (d) attaching the flange to the window frame with fasteners, wherein the film, the flange, the fasteners and the tape together form a security attachment for the window pane.

2. The method of applying the security attachment of claim 1, wherein the film includes:

a laminated film having a thickness of approximately 2 mils to approximately 14 mils.

3. The method of applying the security attachment of claim 1, wherein the flange includes:

a hollow track having a substantially right triangular cross-section with a base portion and a straight back portion perpendicular to the base portion and an angled side.

4. The method of applying the security attachment of claim 3, wherein the flange further includes:

a cap cover having a T-shaped cross-section with a base portion having at least one bulb shaped tip for snapping into a mateable opening within the angled side of the hollow track.

5. The method of applying the security attachment of claim 3, wherein the track further includes:

a step-out portion wall which abuts against a spline of the window pane.

6. The method of applying the security attachment of claim 1, wherein the fasteners are chosen from at least one of:

screws and bolts.

7. The method of applying the security attachment of claim 1, wherein the tape includes:

two-sided plastic tape.

8. The method of applying the security attachment of claim 1, wherein the flange includes:

four sections attaching each film edge to each section of the window frame.

9. A security attachment system for windows comprising the combination of:

a window frame attached to edges of a window pane;

a protective film adhered to and substantially covering one side face of the pane substantially up to the edges of the pane;

tape overlapping both a portion of the window frame and a portion of the edges of the film;

a flange track positioned substantially over the tape; and detachable fasteners attaching the flange to the window frame, wherein the film, the flange, the fasteners and the tape together form a security attachment for the window pane.

10. The security attachment system of claim 9, wherein the tape includes:

two sided tape.

11. The security attachment system of claim 9, wherein the flange includes:

a hollow track having a substantially right triangular cross-section with a base portion for abuting against the portion of the window frame, a straight back portion perpendicular to the base abutting against the portion of the window pane, and an angled side.

12. The security attachment system of claim 11, wherein the track further includes:

a cap cover having a T-shaped cross-section with a base portion having a bulb shaped tip for snapping into a mateable opening within the angled side of the hollow track.

13. The security attachment system of claim 11, wherein the track further includes:

a step-out portion wall which abuts against the edge portion of the window pane.

14. The security attachment system of claim 9, wherein the fasteners are chosen from at least one of:

screws and bolts.

15. The security attachment system of claim 9, wherein the flange includes:

four sections attaching each of the edges of the film to the window frame.

16. The security attachment system of claim 9, wherein the film includes:

a laminated film having a thickness of approximately 2 mils to approximately 14 mils.

17. The security attachment system of claim 11, wherein the track further includes:

a cap cover having a substantially flat top plate with a bent end, and a bent prong beneath the cover for snapping about an edge of an opening within the angled side of the hollow track.

18. The method of applying the security attachment of claim 3, wherein the flange further includes:

a cap cover having a substantially flat top plate with a bent end, and a bent prong beneath the cover for snapping about an edge of an opening within the angled side of the hollow track.

19. A protective attachment system for locking security films to window frames, comprising the combination of:

a window pane having a first face and a second face, and having edges attached to a window frame;

a protective film layer substantially covering the first face of the pane up to the edges of the pane; and a track that overlaps and connects to both a portion of the edges of the film and a portion of the window frame, wherein securing the track to the window frame locks the film to the window frame an adhesive layer beneath the track; said adhesive layer overlapping both a portion of the edges of the film and a portion of the widow frame.

20. The protective attachment system of claim 19, further comprising:

the adhesive layer being a tape layer.

* * * * *